United States Patent [19]

Vieau et al.

[11] 3,995,141

[45] Nov. 30, 1976

[54] FOOD WARMING DEVICE

[75] Inventors: David Pierre Vieau; Youn Hung Ting, both of Attleboro, Mass.

[73] Assignee: Texas Instruments Incorporated, Dallas, Tex.

[22] Filed: Oct. 31, 1975

[21] Appl. No.: 627,730

[52] U.S. Cl. ..... 219/386; 219/441; 219/464; 219/505; 219/521; 219/541; 338/22 R

[51] Int. Cl.[2] ..... F27D 11/2

[58] Field of Search ..... 219/210, 385, 386, 387, 219/449, 441, 464, 505, 521, 530, 541, 544; 338/22 R, 22 SD, 23

[56] References Cited

UNITED STATES PATENTS

| | | | |
|---|---|---|---|
| 2,606,986 | 8/1952 | Sweger | 338/23 X |
| 2,961,524 | 11/1960 | Newman | 219/541 X |
| 3,400,247 | 9/1968 | Deacon | 219/541 X |
| 3,519,798 | 7/1970 | Walther | 219/439 |
| 3,720,807 | 3/1973 | Ting | 219/441 |
| 3,748,439 | 7/1973 | Ting et al. | 219/505 X |
| 3,749,879 | 7/1973 | Armstrong | 219/210 |
| 3,778,594 | 12/1973 | Wightman | 219/430 |
| 3,876,861 | 4/1975 | Wightman et al. | 219/530 X |
| 3,891,827 | 6/1975 | Wyse | 219/441 X |

*Primary Examiner*—Volodymyr Y. Mayewsky
*Attorney, Agent, or Firm*—John A. Haug; James P. McAndrews; Russell E. Baumann

[57] ABSTRACT

A food warmer comprising a heat transfer plate with a flat portion and a flange of thermally and electrically conductive material to which at least one pill of positive temperature coefficient of resistance material is conductively secured and an electrically insulative base with a trough for receiving the rolled edge of the heat transfer plate. The pill is provided with an electrically conductive coating on its two opposite faces. An electrically conductive spring is mounted in the base adapted to make contact with one surface of the electrically conductive coating of the pill. Electrical connection is made to the heat transfer plate and to the spring to provide a current path through the pill upon positioning and sealing the rolled edge with a silicon rubber sealing compound thereby providing proper contact force and alignment between the spring and the conductive coating of the pill along with a water tight seal.

5 Claims, 4 Drawing Figures

FOOD WARMING DEVICE

BACKGROUND AND SUMMARY OF INVENTION

This invention relates to a heating apparatus and more particularly to a heating apparatus especially for use with food warming trays.

Food warming apparatus has been found to be very useful in many situations. For instance when used as part of food trays in a hospital it maintains the food at an optimum temperature even though delivery and actual eating of the food take substantial time.

It was common in the prior art to employ a standard resistance heater coupled with a thermostat to regulate the heat generated in the food warming apparatus. There were many disadvantages with this warming apparatus which are overcome by using a positive temperature coefficient of resistance material along with a heat transfer plate to provide the heat needed. A food warming apparatus of this type is described in U.S. Pat. No. 3,720,807 issued Mar. 13, 1973 to the assignee of the instant invention. Even though great improvement over prior food warming apparatus is achieved using the above-mentioned PTC heater apparatus occasional sealing and low resistance contacting problems occur. These food warming devices are typically a part of trays which are immersed in water and therefore any leakage causes problems. Additionally proper low resistance contacting with the PTC pill is needed for long, reliable operation.

It is an object of the present invention to provide a food warming apparatus with an improved low resistance contacting and sealing system. Another object of this invention is to provide an apparatus which is easily produced and assembled at minimal cost. Other objects and features will be in part apparent and in part pointed out hereinafter.

Briefly the present invention comprises a food warming apparatus employing at least one PTC resistance heater pill in thermal communication with a relatively large heat transfer plate with a flange having high heat conductivity. Heat generated in the pill is conducted away from the pill to the plate thus keeping the pill in a low resistance state until the plate heats up at which time the pill changes to a high resistance state for reducing heat output. The pill is metallized on opposite faces and secured to the heat transfer plate. A base member having a recess or trough for receiving and positioning the flange of the plate and having a spring secured thereto by a post to make electrical contact with the PTC pill is made out of electrically and thermally insulative material. A sealing silicon rubber compound is disposed in the trough to provide a water tight seal totally surrounding the flange and to retain the heat transfer plate in position to provide a low resistance electrical contact between the PTC and the spring by properly aligning and permanently positioning the spring in contact with one of the metallized surfaces of the pill. An electrical circuit is made from the heat transfer plate through the PTC pill and spring to an electrical lead connected to the spring.

In the accompanying drawings in which one of various possible embodiments of the invention is illustrated:

Similar reference characters indicate corresponding parts throughout the various views of the drawings.

Figure 1:
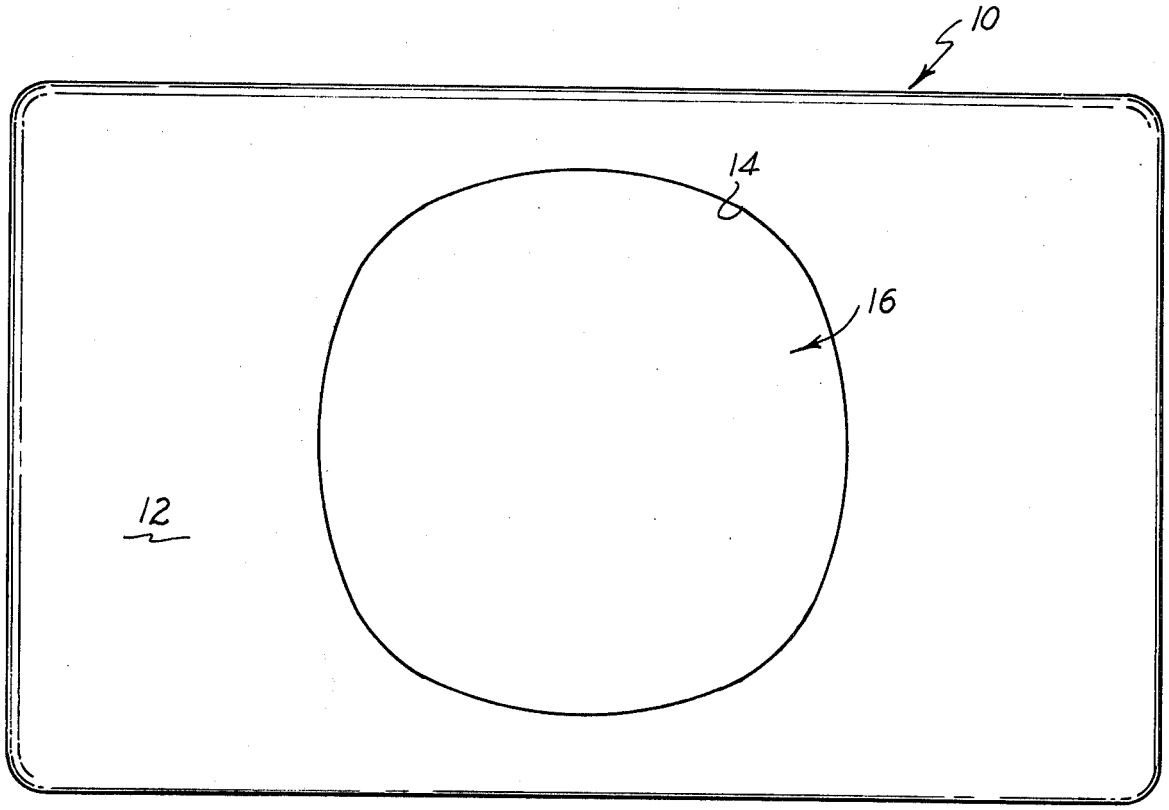
FIG. 1 is a top plan view of a food warming tray incorporating a food warming apparatus of this invention.

Dimensions of certain of the parts as shown in the drawings may have been modified or exaggerated for the purpose of clarity of illustration.

Referring now to the drawings, FIG. 1 shows a food warming tray 10 comprising a tray member 12 typically made out of a light easily cleaned material such as fiber glass. Within tray member 12 is an aperture 14 in which a food warming apparatus 16 is secured. It is to be understood that more than one aperture and food warming apparatus secured therein may be used with the food warming tray. Various types of food containers may be used in connection with food warming tray 10 as diagrammatically indicated by broken lines 13 in FIG. 2.

Figure 2:
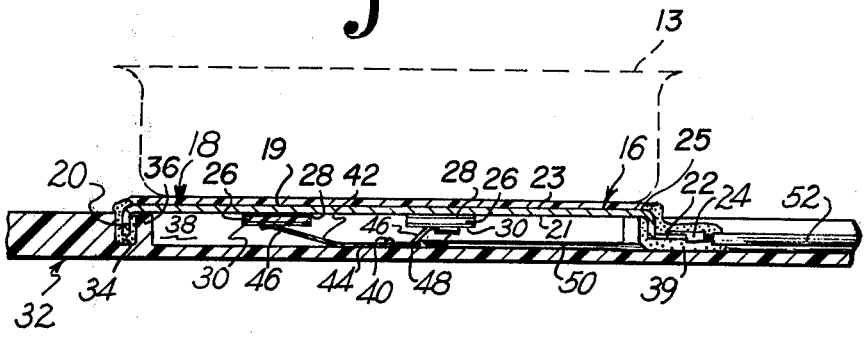
FIG. 2 is a cross section view of the food warming apparatus of FIG. 1.

As seen in FIG. 2 food warming apparatus 16 comprises a plate member 18 with a flange or rolled edge 20 around its circumference. Preferably the plate member 18 has a flat surface portion 19 and the flange 20 depending from the flat surface portion substantially around the entire parameter of the flat surface portion. Plate member 18 has an inside surface portion 21 and an outside surface portion 23. Outside surface portion 23 is preferably covered with an insulating material 25. The plate is made of a highly thermally and electrically conductive material such as aluminum. One part of flange 20 is bent back as shown in FIGS. 2 and 3 and has an additional tab member 22 which serves as an electrical terminal 24 for the apparatus to be discussed in more detail below.

Figure 3:
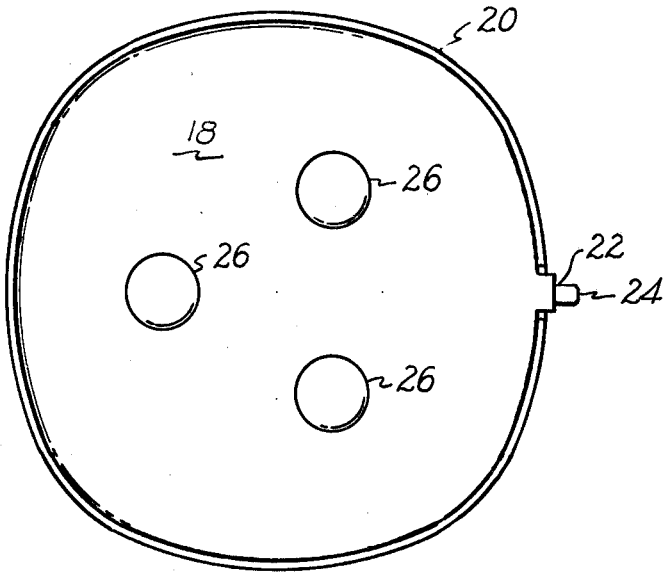
FIG. 3 is a bottom plan view of a heater plate member of the food warming apparatus of FIG. 2.

Three pills 26 of positive temperature coefficient of resistance material are secured to inside surface portion 21 of plate member 18 preferably 120 degrees apart around the center of the plate as shown in FIG. 3. The three pills 26 (or any other desired number) are employed as the heating elements having a first relatively low resistance state at temperatures below an anomaly and second relatively high resistance state at temperatures above the anomaly. In order to self-control and obviate the need of a thermostat, the PTC slope above the anomaly temperature must be very steep so that the resistance of the pills will rise several orders of magnitude within just a few degrees of temperature. Such material that provides this steep slope property is barium titanate doped with a rare earth material (e.g. $Ba_{.997}La_{.003}TiO_3$).

Pills 26 are provided with electrically conductive coatings 28 and 30 on first and second faces thereof respectively. Conductive coating 28 on the first face is preferably provided with a single layer of aluminum applied for instance by flame spraying to obtain a good ohmic contact of high physical strength with pills 26. Conductive coating 30 on the second face preferably has a layer of copper or other suitable metal in addition to the layer of aluminum to improve its contacting properties. Pills 26 are secured to plate 18 as by cementing conductive coating 28 with an electrically conductive adhesive.

Figure 4:
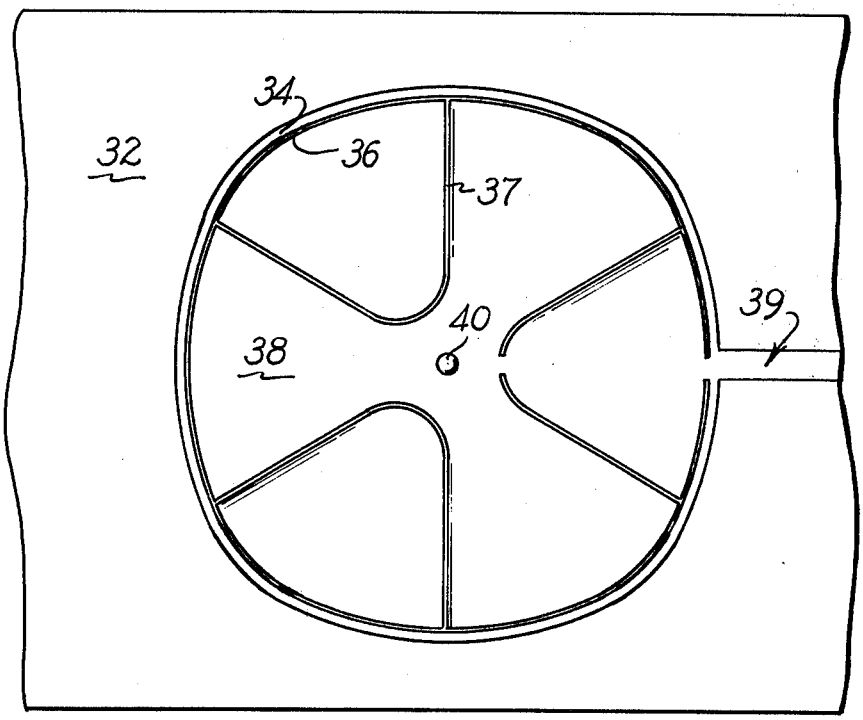
FIG. 4 is a top plan view of a base member of the food warming apparatus of FIG. 2.

A base member 32 of food warming apparatus 16 as shown by FIG. 4 is made from an electrically and thermally insulative material similar to the type used for tray member 12. Base member 32 has a generally circular trough 34 adapted to receive flange 20 and a ridge 36 bordering the trough on the inside. Preferably, trough 34 has a width permitting reception of flange 20 therein with selected spacing between each of the side walls of the trough and the opposite side surfaces of the flange. Preferably also the depth of the trough is such that, with the flat portion 19 of the plate engaged with the ridge as shown in FIG. 2 the edge of the flange has a selected spacing from the bottom of the trough. Inside the ridge 36 is a recess area 38 with a post member 40 centrally located in recess 38. Additional ridge members 37 (not shown in FIG. 2) may be provided in recess 38 to provide support of plate 18 if needed. Preferably the ridge 36 has a separation therein and the outer wall of the trough is recessed as shown at 39 in FIGS. 2 and 4 in general alignment with this separation.

A spring member 42 as shown by FIG. 2 has a central aperture so as to be able to fit on post member 40 and be secured thereto by any conventional means. Spring member 42 is formed of electrically conductive material having good spring characteristics such as a phos bronze alloy, and is generally of the spider type with a bight portion 44 with 3 legs 46 extending therefrom equidistant from one another. The free distal end portions of the legs are bent back upon themselves to provide a large uniform contacting surface. Electrical connection is made with spring 42 preferably by a connector 48 as shown in FIG. 2 which also fits over post 40 and is secured thereto in direct electrical contact with the spring.

In accordance with this invention plate member 18 with flange 20 is disposed in trough 34 and then secured therein preferably with a silicon rubber sealing compound such as a room temperature vulcanizing material. Preferably, the flange fits easily in the trough allowing the sealing compound to form around and adhere to both sides and the bottom of the flange while also adhering to the side walls and bottom of the trough thereby providing a reliable fixed seal. The tab 22 which fits into the trough wall recess 39 is also completely surrounded with sealing compound thereby sealing up that opening. This seal will protect food warming apparatus 16 from receiving water or the like even during high temperature and pressure cleaning operations. This arrangement of plate member 18 in base 32 also positions the PTC pill in desired engagement with the spring member 42 so that the bias of each of legs 46 makes low resistance electrical contact with respective conductive coatings 30 on the pills and the adhesion of the sealant to the large surface area of the flange provides fixed positioning of the legs 46 relative to respective pills. This sealing configuration minimizes burnout of the conductive layer due to electrical point contact and galling of the surface.

Accordingly an electrical connection means 50 provides electrical connection from the spring to an external power source through the wall recess 39. Another connection means 52 makes electrical contact to terminal 24 to complete the circuit.

Thus it will be seen that a food warming apparatus with a water tight seal and reliable low resistance heating elements provide the desired superior operating characteristics.

As many changes could be made in the above constructions without departure from the scope of the invention, it is intended that all matter contained in the above description or shown in the accompanying drawings, shall be interpreted as illustrative and not in a limiting sense, and it is also intended that the appended claims shall cover all such equivalent variations as some within the true spirit and scope of the invention.

It is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

We claim:

1. Food warming apparatus comprising:

an insulative base member having a central recess and a trough surrounding said recess providing a ridge between said trough and said recess;

a spring member secured in said recess having at least one leg member;

an electrically and thermally conductive plate member with a flange being disposed in said trough of said base member, said plate having an outer surface and an inner surface;

at least one pill of positive temperature coefficient of resistance with first and second faces having an electrically conductive coating attached to said faces;

an electrically conductive adhesion means connecting the electrically conductive coating on the first face of the pill and the inner surface of the plate member;

a sealing means which substantially surrounds and permanently fixes said flange of said plate member in said trough of said base member with said second face of said pill in electrical contact with said spring leg thereby providing a water tight seal and a low contact resistance connection;

electrical connector means to connect said plate member and said spring member to an electrical power source; and insulating means covering the outer surface of said plate member and electrically insulating thereof.

2. Food warming apparatus as set forth in claim 1 wherein said sealing means is a silicon rubber sealing compound.

3. Food warming apparatus as set forth in claim 2 wherein the number of pills is 3 spaced 120° from one another and the number of spring leg members is 3 each one making low resistance electrical contact with one of the three pills.

4. Food warming apparatus as set forth in claim 3 in which the pills are composed of doped barium titanate, the coating on the first face comprises a layer of aluminum, the coating on the second face comprises a layer of aluminum and a layer of copper, the aluminum layer being intermediate the pill and the copper layer.

5. A food warming tray in which at least one food warming apparatus is secured, said food warming apparatus comprising:

an insulative base member having a central recess and a trough surrounding said recess providing a ridge between said trough and said recess;

a spring member secured in said recess having at least one leg member;

an electrically and thermally conductive plate member with a flange being to be disposed in said trough of said base member, said plate having an outer surface and an inner surface;

at least one pill of positive temperature coefficient of resistance with first and second faces having an electrically conductive coating attached to said faces;

an electrically conductive adhesion means connecting the electrically conductive coating on the first face of the pill and the inner surface of the plate member;

a sealing means which substantially surrounds and permanently fixes said flange of said plate member in said trough of said base member with said second face of said pill in electrical contact with said spring leg thereby providing a water tight seal and a low contact resistance connection;

electrical connector means to connect said plate member and said spring member to an electrical power source; and insulating means covering the outer surface of said plate member and electrically insulating thereof.

* * * * *